United States Patent [19]

Blasiole

[11] Patent Number: 4,972,786

[45] Date of Patent: Nov. 27, 1990

[54] FINNED TUBED ROTARY COMBUSTOR

[75] Inventor: George A. Blasiole, Greensburg, Pa.

[73] Assignee: Westinghouse Electric Corp., Pittsburgh, Pa.

[21] Appl. No.: 505,635

[22] Filed: Apr. 6, 1990

[51] Int. Cl.[5] ..... A47J 36/00

[52] U.S. Cl. ..... 110/246; 110/234; 432/117; 432/118; 432/103; 432/115

[58] Field of Search ..... 110/246, 234; 432/117, 432/118, 77, 103, 115

[56] References Cited

U.S. PATENT DOCUMENTS

| | | | |
|---|---|---|---|
| 4,735,156 | 4/1988 | Johnson et al. | 110/246 |
| 4,735,157 | 4/1988 | Jurusz | 110/246 |
| 4,782,766 | 11/1988 | Lee et al. | 110/234 |
| 4,782,768 | 11/1988 | Lee et al. | 432/117 |
| 4,782,769 | 11/1988 | Lee et al. | 432/103 |
| 4,870,912 | 10/1989 | Lee | 110/23 X |
| 4,889,058 | 12/1989 | Yang et al. | 110/246 |
| 4,889,059 | 12/1989 | Whitlow et al. | 110/226 |

*Primary Examiner*—Henry C. Yuen

*Attorney, Agent, or Firm*—Fred J. Baehr, Jr.

[57] ABSTRACT

A finned tube rotary combustor for a municipal solid waste incinerator having a plurality of finned tubes disposed in a circular array so that the fins of adjacent tubes register, but are separate and form a gap for combustion air to pass from a divided windbox into the rotary combustor, the finned tubes being connected at each end to a ring header and at intermediate locations by channel shaped circumferential bands that have an outer peripheral surface that is utilized as the running surface for windbox radial seals and has legs with scalloped distal margins fitted and welded to the outer periphery of the finned tube array.

8 Claims, 3 Drawing Sheets

FINNED TUBED ROTARY COMBUSTOR

BACKGROUND OF THE INVENTION

The invention relates to a municipal solid waste incinerator and more particularly to a finned tube rotary combustor for the incinerator.

Rotary combustors are made of a circular array of spaced apart cooling tubes with a perforated web plate disposed between adjacent tubes. Cooling fluid, water and some steam passes through the tubes which are arranged in alternating banks or inlet or supply tubes and outlet or return tubes. The webs were welded to each tube with continuous welds whereby adjacent tubes were rigidly connected along their entire length.

SUMMARY OF THE INVENTION

Among the objects of the invention may be noted the provision of a rotary combustor which can be manufactured at reduced cost with substantially fewer welds, which has tubes can be more easily replaced, which facilitates field erection allowing larger units to be built in the field without shipping size limitations and which diminishes axial stresses between the banks of tubes.

In general, a finned tube rotary combustor for a solid municipal waste incinerator disposed on an inclined axis within a windbox that encloses the central portion of the finned tube rotary combustor , when made in accordance with this invention, comprises a circular array of spaced apart cooling tubes connected at each end to a ring header in banks of inlet and outlet tubes. Each tube has a pair of diametrically opposed fins so disposed that the fins on adjacent tubes register, but are separate and provide passage ways for combustion air to enter the finned tube rotary combustor from the windbox. A plurality of bands are disposed to extend girthwise around the finned tube rotary combustor. The bands are fastened to the tubes and having a generally cylindrical peripheral surface. A seal member is fastened to the windbox and extends therefrom at an angle so as to engage the cylindrical surface and form a running seal therebetween. The finned tube rotary combustor described herein is more economical to manufacture and maintain and the axial shear stresses induced by the temperature gradient in adjacent banks of the tubes are diminished.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
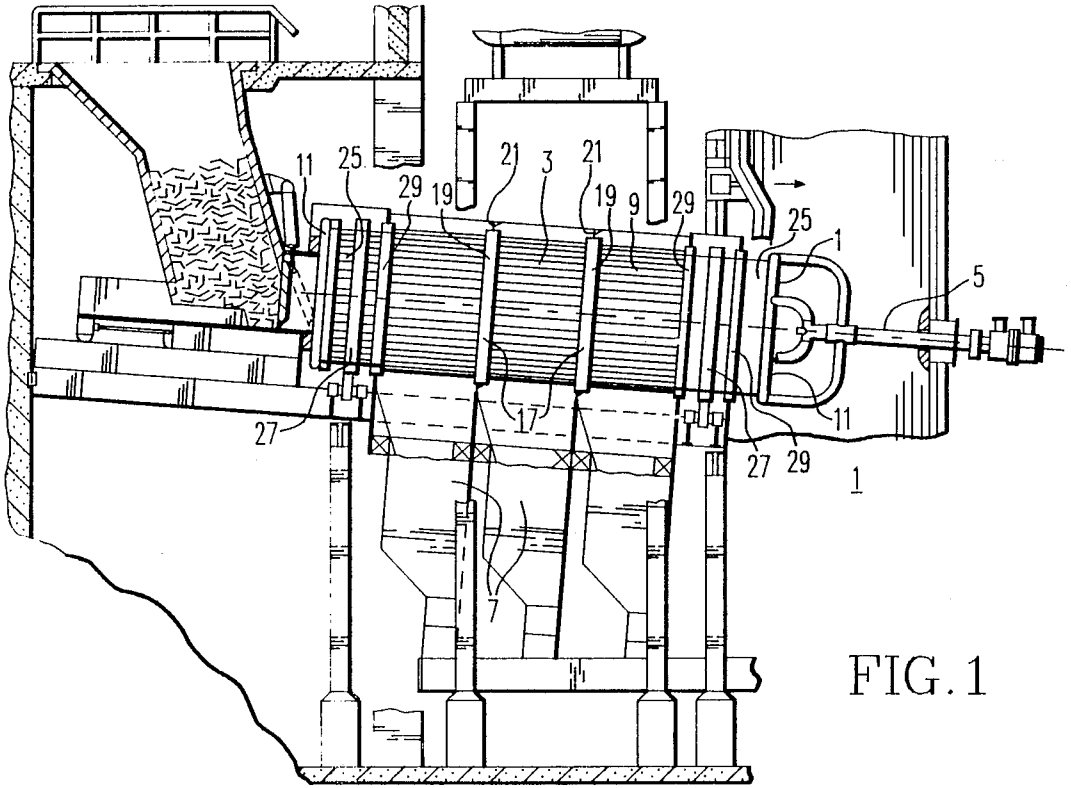
FIG. 1 is a partial sectional view of a municipal solid waste incinerator showing the rotary combustor.

Referring now to the drawings in detail and in particular to FIG. 1 there is shown a portion of a municipal solid waste incinerator 1 having a finned tube rotary combustor 3 disposed for rotation on a inclined axis 5 in a divided windbox 7.

Figure 2:
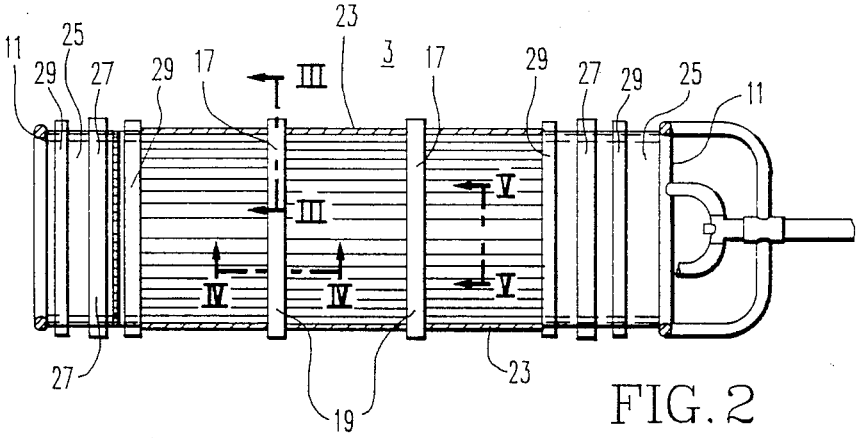
FIG. 2 is an enlarged elevational view of a rotary combustor with finned tubes.
Figure 3:
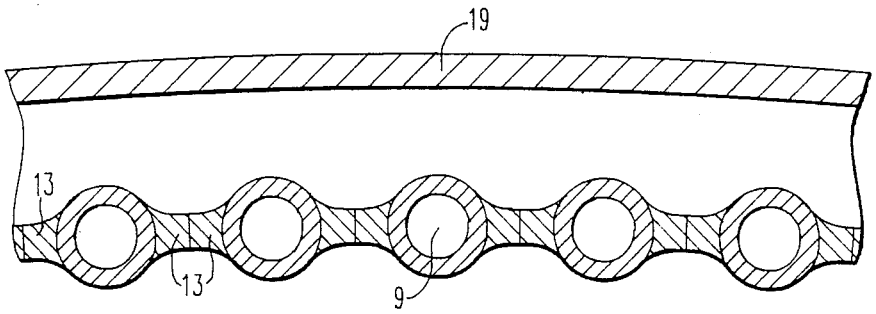
FIG. 3 is an enlarged partial sectional view taken on line III—III of FIG. 2.
Figure 4:
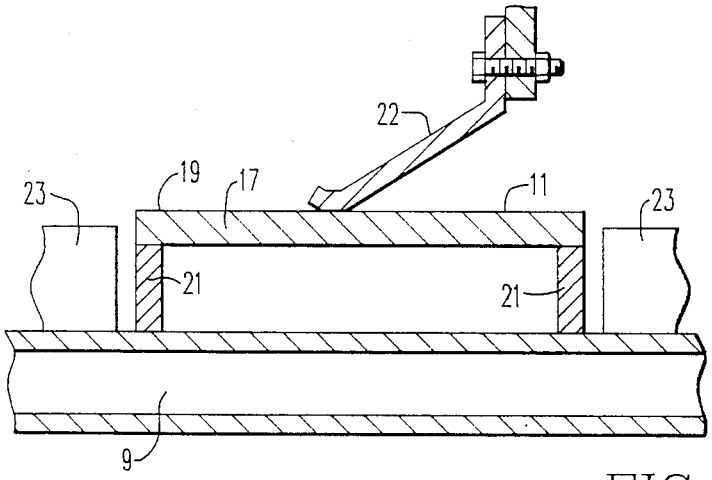
FIG. 4 is an enlarged partial sectional view taken on line IV—IV of FIG. 2.

As shown in FIGS. 2, 3 and 4, the finned tube rotary combustor 3 comprises a circular array of separate finned cooling tubes 9 connected at each end to a ring header 11 and arranged in supply and return banks for circulating the cooling fluid through the finned tubes 9. Each finned tube 9 has an integral pair of diametrically opposed fins 13 so disposed that the fins 13 on adjacent tubes 9 register. Even though the fins 13 register they are separate providing gaps or passage ways 15 for combustion air to enter the finned tube rotary combustor 3 from the windbox 7. A plurality of bands 17 are disposed to extend girthwise around the finned tube rotary combustor 3. The bands 17 are channel shaped having a generally smooth cylindrical peripheral surface 19 and a pair legs 21 disposed ar right angles to the cylindrical surface 19 with distal scalloped margins configured to fit the outer peripheral surface of the finned tubes 9. The scalloped margins are welded to the outer peripheral surface of the finned tubes 9.

As shown in FIG. 4 a plurality of seal members 22 formed of spring steel are fastened to the windbox 7 and extending therefrom at an angle so as to engage said cylindrical surface 19 forming a running seal between compartments in the windbox 7. The distal end of the seal member 22 is bent away from the cylindrical surface 19 providing contact between two smooth surfaces. FIG. 2 and 4 also show elongated flat bars 23 extending radially outwardly from the finned tubes 9 and are the bars 23 to which cooperating axial seal members (not shown) are attached. The end portions of the rotary combustor 3 each have a cylindrical shell portion 25 mounted over the outside of the finned tubes 9. Tires 27 upon which the rotary combustor 3 rotates are fastened to the cylindrical shell portions 25 together with a pair of radial seal surfaces 29 embracing each tire 27, the seal assemblies which mate with the radial seal surfaces are not shown.

Figure 5A:
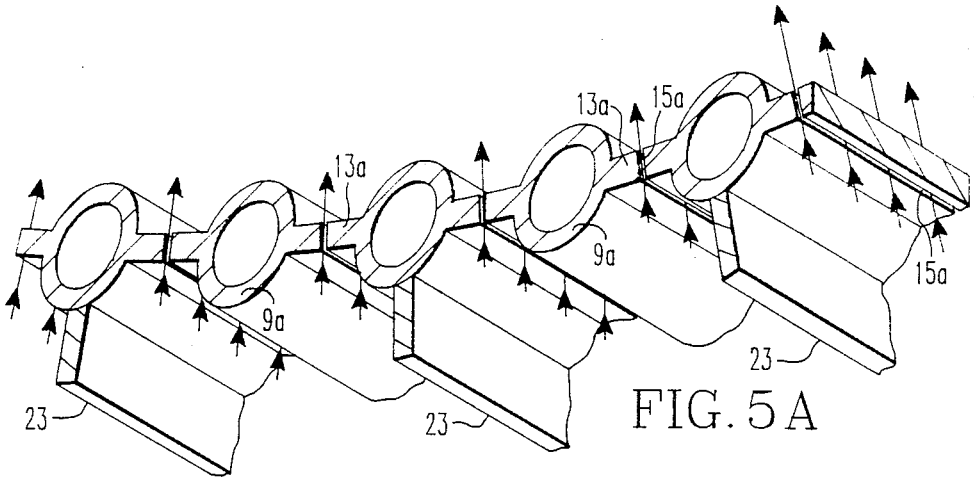
FIGS. 5 A, B and C are enlarged partial sectional views taken on line V—V of FIG. 2, showing alternative embodiments.

FIG. 5A shows fins 13A made integral with tubes 9A and having square distal margins. The fins 13A of one tube 9A register with the fins 13A of the adjacent tubes 9A and are spaced apart forming a gap 15A between the adjacent fins 13A for the passage of combustion air into the combustor 3.

Figure 5B:
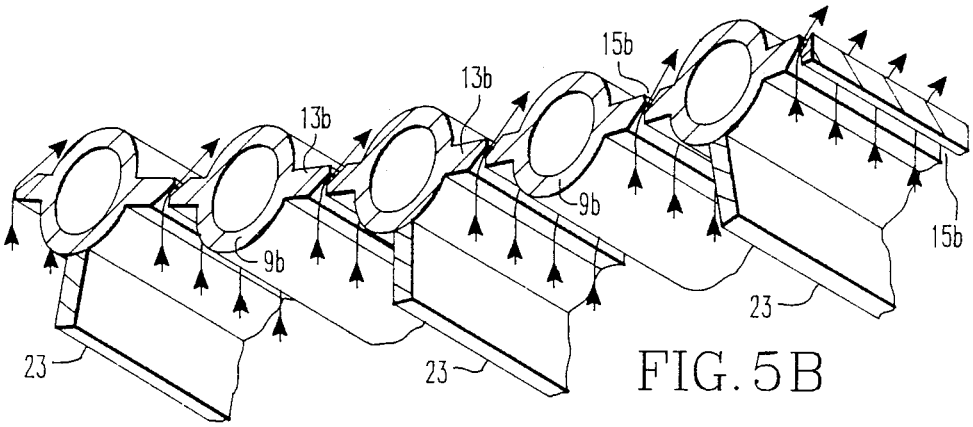

In FIG. 5B fins 13B extending from tubes 9B have a chamfer 33 disposed on complimentary distal margins of the fins 13B so as to form a gap 15B, which directs combustion air into the rotary combustor 3 in a direction generally opposite to the direction of rotation of the rotary combustor 3 and disposed so that the gap 15B is about ⅛ inch (3 mm) wide. The size of the gap 15B and its orientation cooperate with the combustion air flowing from the windbox 7 and the tendency of the waste to ride up on one side of the rotary combustor 3 to prevent molten aluminum from the waste from flowing through the gap 15B and into the windbox 7. The chamfer 33 is also disposed to provide a stout edge on the margin of the fin 13B for preventing the solid waste tumbling in the rotary combustor 3 from damaging the edges of the fins 13B.

Figure 5C:
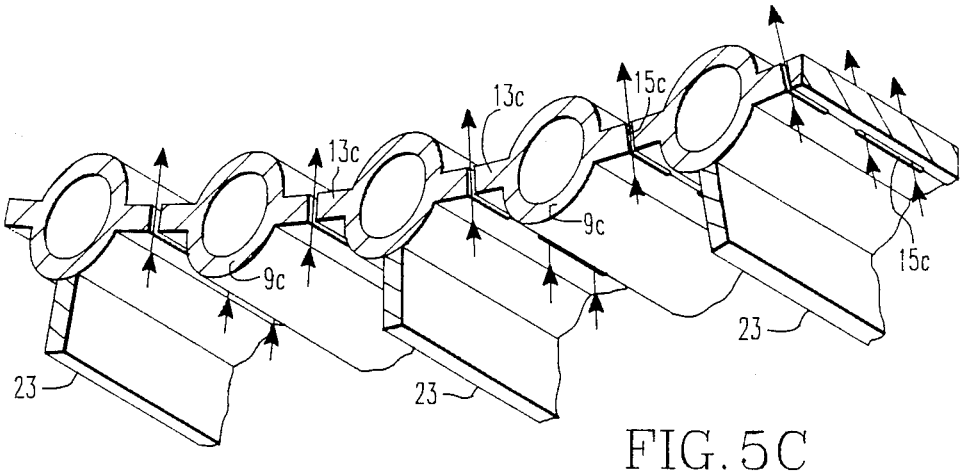

Finned tubes 9C, shown in FIG. 5C, are so disposed that adjacent fins 13C abut, but are not joined together and have slots 35, which may register and which form openings for the combustion air to enter the rotary combustor 3 form the windbox 7.

The finned tube rotary combustor 3 described herein advantageously provide an integral fin arrangement which enhances fin cooling lowering the operating temperature of the finned tube 9 to reduce degradation by corrosion, reduces manufacturing cost as there is a substantial reduction in welds and no need to drill holes in the thick webs, provides for easier replacement of the finned tubes 9, facilitates field erection allowing larger units to be built in the field without considering shipping limitations and diminishes axial stresses between the banks of finned tubes 9 extending the life of the rotary combustors 3.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. A finned tube rotary combustor for a solid municipal waste incinerator disposed on an inclined axis within a windbox enclosing the central portion of said finned tube rotary combustor which comprises a circular array of spaced apart cooling tubes connected at each end to a ring header in banks of inlet and outlet tubes, each tube having a pair of diametrically opposed fins so disposed that the fins on adjacent tubes register, but are separate and provide passage ways .for combustion air to enter the finned tube rotary combustor from the windbox; a plurality of bands extending girthwise around the finned tube rotary combustor, the bands being fastened to the tubes and having a generally cylindrical peripheral surface and a seal member fastened to the windbox and extending therefrom at an angle so as to engage said cylindrical surface forming a running seal therebetween to form the finned tube rotary combustor with diminished axial shear stresses induced by the temperature gradient in adjacent banks of said tubes.

2. The finned tube rotary combustor of claim 1, wherein the fins are made integral with the tube.

3. The finned tube rotary combustor of claim 1, wherein the bands are formed in the shape of a channel having a pair of legs with distal margins that are scalloped to fit over the outer periphery of the tube and fin array.

4. The finned tube rotary combustor of claim 1, wherein the fins are spaced apart to form the passage ways for the combustion air to enter the finned tube rotary combustor.

5. The finned tube rotary combustor of claim 4, wherein distal margins of the fins are chamfered at complimentary angles so as to form an angled slot between adjacent fins.

6. The finned tube rotary combustor of claim 5, wherein the direction of air flow through the angled slot is generally in a direction opposite to the direction of rotation of the finned tube rotary combustor; the angled slot cooperating with the influent combustion air and the tendency of tumbling solid waste to ride up on one side of the finned tube combustor to prevent molten aluminum from running through the angled slots and into the windbox.

7. The finned tube rotary combustor of claim 6, wherein the chamfer is disposed to provide fins with stout edges which will not be easily damaged by the tumbling solid waste.

8. The finned tube rotary combustor of claim 7, wherein the angled slot is about $\frac{1}{8}$ inch wide.

* * * * *